US006569080B2

(12) United States Patent
Dykes et al.

(10) Patent No.: US 6,569,080 B2
(45) Date of Patent: May 27, 2003

(54) DOOR LATCHING MECHANISM FOR INFANT CARE APPARATUS

(75) Inventors: Christopher A. Dykes, Columbia, MD (US); Peter K. Hundertmark, Laurel, MD (US)

(73) Assignee: Datex-Ohmeda, Inc., Madison, WI (US)

( * ) Notice: Subject to any disclaimer, the term of this patent is extended or adjusted under 35 U.S.C. 154(b) by 115 days.

(21) Appl. No.: 09/732,542

(22) Filed: Dec. 8, 2000

(65) Prior Publication Data

US 2002/0072648 A1 Jun. 13, 2002

Related U.S. Application Data

(60) Provisional application No. 60/170,145, filed on Dec. 10, 1999, and provisional application No. 60/182,137, filed on Feb. 12, 2000.

(51) Int. Cl.[7] ..... A61G 11/00
(52) U.S. Cl. ..... 600/22; 600/21
(58) Field of Search ..... 600/21, 22

(56) References Cited

U.S. PATENT DOCUMENTS 4,121,571 A 10/1978 Pickering
5,186,345 A 2/1993 Ching
6,231,499 B1 * 5/2001 Jones ..... 600/22

FOREIGN PATENT DOCUMENTS

| | | |
|---|---|---|
| GB | 701626 | 12/1953 |
| IT | 219405 | 2/1993 |
| WO | WO99/12512 | 3/1999 |

* cited by examiner

*Primary Examiner*—Henry Bennett
(74) *Attorney, Agent, or Firm*—Roger M. Rathbun

(57) ABSTRACT

An infant apparatus having a base, a vertically movable hood and a plurality of walls that form an infant compartment. The apparatus has lateral side walls and a front end door that can be individually opened. There is an interlocking engagement between the upper periphery of the lateral walls and hood by a plurality of pins on the hood that engage brackets located at the top of the front and rear end walls. A latching arrangement allows all three doors to be opened. The side lateral doors are latched by a movable latch member that enters an opening in brackets affixed to the front and rear end walls. The front end wall can be moved vertically upwardly to disengage its latching arrangement to enable it to pivot downwardly. An alignment mechanism is also provided to insure that the movable latch members correctly align with the openings in the brackets.

21 Claims, 6 Drawing Sheets

38
38
46
18
38
46
26
28
34
30
16
38
26
34
28
32
30
12
12
28
34
36
48
44
42
22
24
20
10
34
36
28
32
30
22
12
20
24
14

38
38
46
18
10
26
34
46
38
26
34
28
16
A
24
42
A
42
44
24
44
12
24
8
30
32
24
30
32
20
22
12
20
22
32
28
30
36
34
30
16
36
32
28
34

FIG. 6A
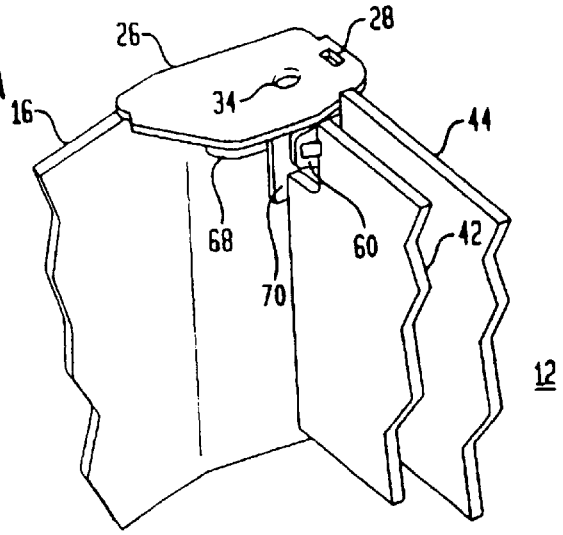
FIG. 6B
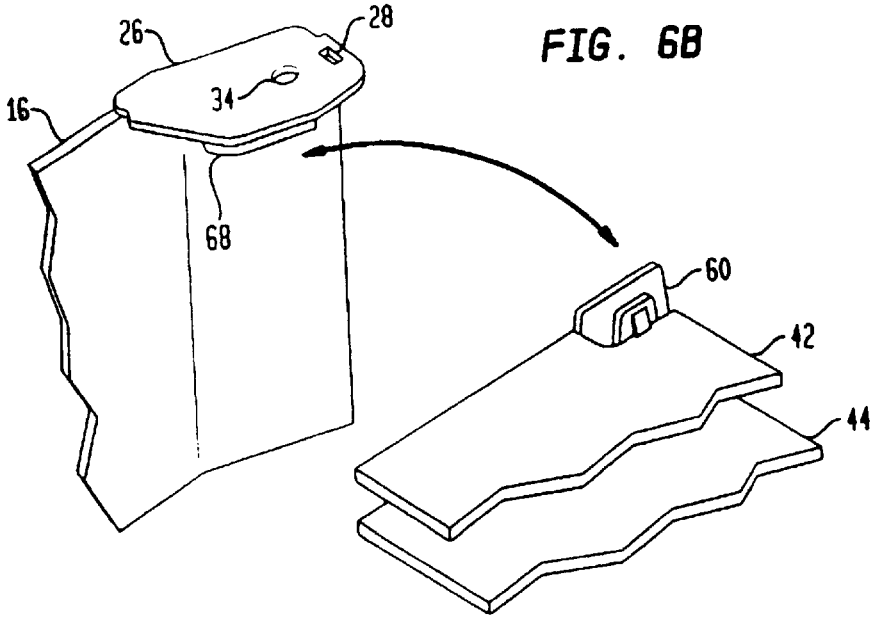
FIG. 6C
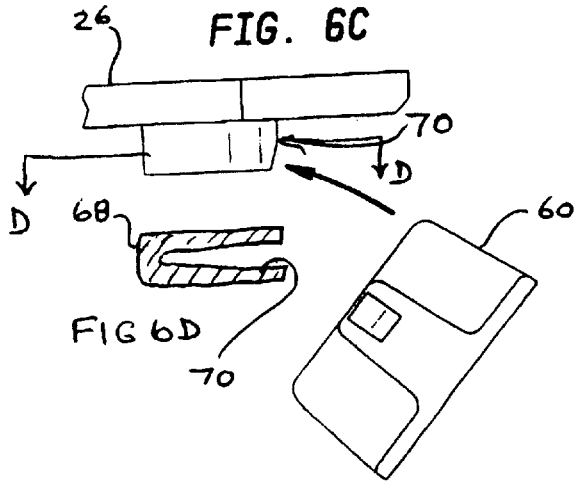
FIG 6D

DOOR LATCHING MECHANISM FOR INFANT CARE APPARATUS

RELATED CASES

The present application is based upon Provisional Patent Application Ser. No. 60/170,145, filed Dec. 10, 1999 and Provisional Patent Application Ser. No. 60/182,137, filed Feb. 12, 2000.

BACKGROUND

The present invention relates to an infant care apparatus and, more particularly, to an improved means of aligning and providing stability for various components that make up the infant care apparatus, including the access doors and vertically movable hood.

In the use of infant incubators, the infant care apparatus normally includes an infant compartment within which the infant is positioned and which provides to that infant, a controlled environment to aid in the wellbeing of the infant. It is common for the walls of such compartment to have doors so that the caregiver can have access to the interior of the incubator to carry out an intervention on the infant or simply to place the infant into the incubator or remove the infant therefrom. Normally, the wall itself is the door as the entire wall or side of the infant compartment can be opened by the user, thus, one or more walls may be, in effect, a door or doors to access the internal area of the infant incubator.

It is also common that the doors swing open in an outwardly and downwardly direction so that the doors can swing free to provide full access to the infant. Typical of such doors can be seen in U.S. Pat. No. 4,936,824 of Koch et al. Accordingly the normal doors are hinged at their bottom and have latches at their top or upper side areas that can secure the door in a closed position and which latches also can be readily opened by the user. While the construction of the latching mechanisms of such doors is a relatively straight forward engineering task where there are only side doors and where the ends of the incubator are fixed, it becomes more of a problem when the apparatus has three doors that can be opened, that is, along the two elongated lateral sides as well as at one of the ends.

As will be used hereinafter by convention, the sides of the infant apparatus will be referred to as the sides paralleling the body of the infant while the ends will be referred to as the rear end, where the infant's head is generally positioned and which is also adjacent the monitoring and control functions of the infant care apparatus and the front end where the feet of the infant normally are positioned and which area extends away; in cantilever fashion, from the main frame and structure of the infant care apparatus. An example of such an apparatus is shown and described in U.S. Pat. No. 0,00,000 of Donnelley et al.

In such an apparatus with three doors, that is, at the two lateral sides and at the front end of the apparatus, it is obviously important for each of the side doors and the end front door to be openable individually, or, to be able to open all of the doors at the same time without detracting from the overall integrity of the apparatus so as to maintain strength and rigidity to the overall structure. Thus, a door latching mechanism and structural system is needed that would allow all three of such doors to open individually or all at the same time where the apparatus has doors on three sides of the infant compartment to gain access to the infant. In such case, the door and structure for the overall infant apparatus must be sufficiently solid and not sacrifice the integrity of the apparatus, yet there must be a latching arrangement to allow each door to be opened.

The problem is thus compounded further where the infant apparatus has a hood that is vertically movable. Such hood has a lower portion where the overall apparatus is functioning as a normal infant incubator and the hood seals against the upper peripheral edges of the sides and ends of the apparatus to form an infant compartment and an upper position where the hood is displaced upwardly with respect to the sides and ends and thus opens the infant compartment. When in the upper position, the hood may also serve to function as a radiant warmer for the infant apparatus, however, in any event, whatever the function of the vertically movable hood, it is clear that when the hood is displaced upwardly to its upper position, there is a more serious structural and integrity problem facing the designer since the sides and ends lack the support that is normally afforded by having a fixed upper hood component and, additionally, there is the problem of providing some system to interengage the upper peripheral edges of the sides and ends with the hood when the hood is moved to its lower position.

Thus, with the use of an overhead vertically movable hood, it is also important to provide a means of aligning that hood with the other components of the infant apparatus, and, in particular, with the side doors and end door to lend structural integrity to the overall apparatus. Due to the tolerances present in the manufacturing of relatively large plastic molded components, such as doors and a hood for use in construction an infant apparatus of the present inventive type, some means is necessary for the hood to interfit with the doors to provide accurate alignment as well as add stability to the overall apparatus to provide that needed integrity.

SUMMARY OF THE INVENTION

Accordingly, the present invention relates to a means of stabilizing and providing an infant apparatus where there are three doors that can be opened, all of which are hinged at their bottom and which swing downwardly and outwardly. The doors are the side doors and the front end door to enable full access to and infant positioned within the apparatus. With the present system, any one of the three doors may be opened by the user and the remaining doors will still be structurally strong and sufficiently rigid. The system allows all three doors to be opened at the same time or any lesser number of doors as desired by the user. The system further provides, and maintains, integrity to the overall infant apparatus with the doors in any variety of positions and also provides an additional structural support for the side doors when the hood is in its lowered position. In the preferred embodiment, the side doors are double walled construction.

Thus, in the present invention, a door latching system is shown that allows the use of three doors to be operable on an infant apparatus and each door can be opened and closed individually or collectively and yet, the overall structure of the walls surrounding the infant compartment are structurally sound. In addition, there is an integrity system that affixes a vertically movable hood to the upper peripheral edges of the three doors when the hood is lowered to its closed position wherein the infant compartment is operating as an incubator.

BRIEF DESCRIPTION OF THE DRAWINGS

FIGS. 6A and 6B are perspective views of an alignment feature for the side doors of the present invention, FIG. 6C is an enlarged side view of the same feature and FIG. 6D is a cross-sectional view taken along the lines D—D of FIG. 6C.

DETAILED DESCRIPTION OF THE INVENTION

Figure 1:
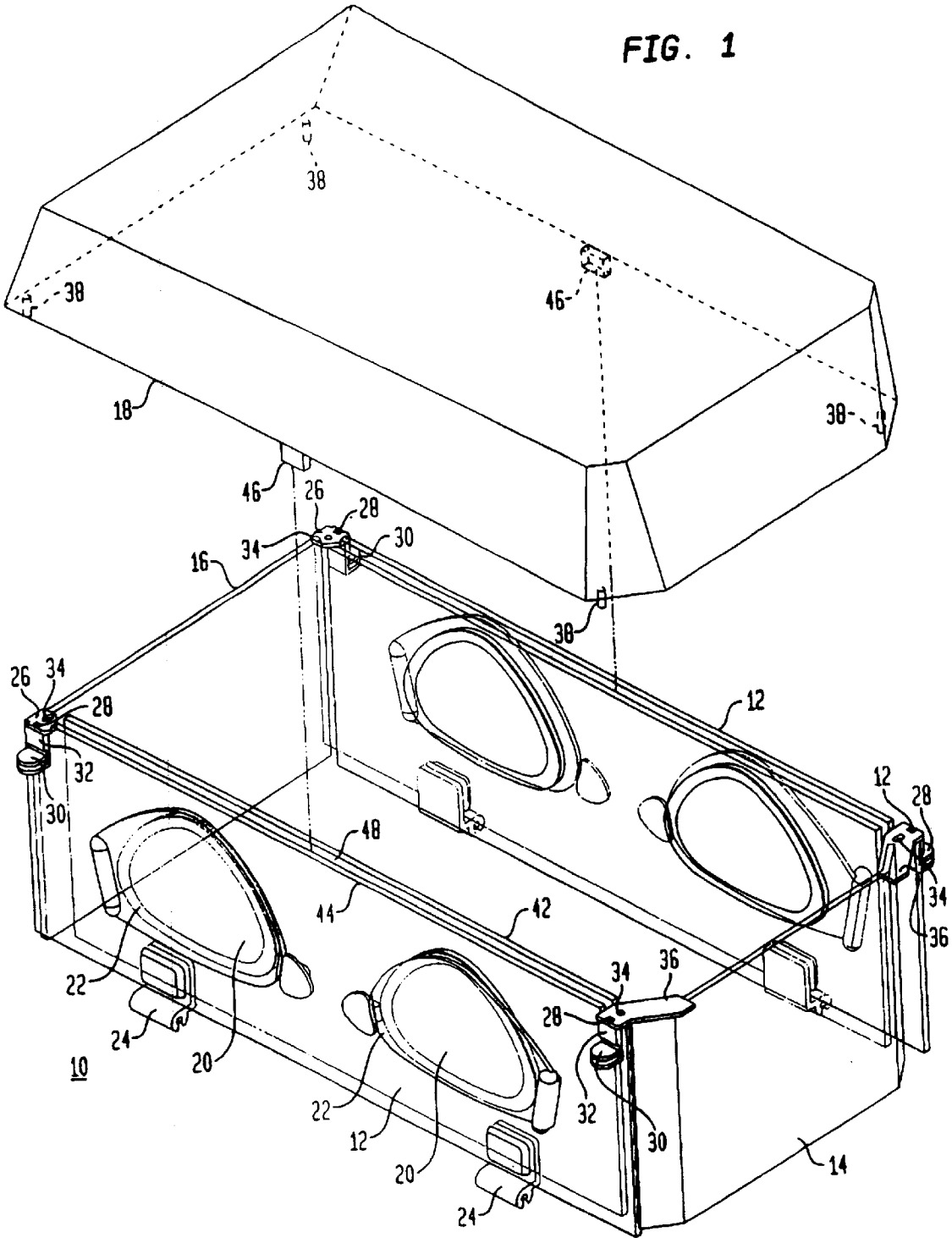
FIG. 1 is a perspective view of an infant incubator constructed in accordance with the present invention.

Referring now to FIG. 1, there is shown a perspective view of the incubator 10 constructed in accordance with the present invention and which includes side doors 12 and a front end door 14. There is also an rear end wall 16 that is preferably fixed in position to the apparatus and ail of the doors 12, 14, and the rear end wall 16, in use, surround an planar surface on which the infant is positioned. A hood 18 overlies the doors 12, 14 and rear end wall 16 and is vertically movable so as to be raised and lowered with respect to the upper peripheral edges of the doors 12, 14 and the rear end wall 16.

Thus, when the hood 18 is in its lower position it seals again those upper edges of the doors 12, 14 and the rear end wall 16 to form the infant compartment to contain the infant in a protective environment. A typical infant incubator is shown and described in U.S. Pat. No. 4,936,824 of Koch et al and an infant apparatus having vertically movable hood is shown and described in U.S. Pat. No. 5,453,077 of Donnelly et al.

As is conventional, the side doors 12 and 14 may have handholes 20 with handhole doors 22 to cover the handholes 20 when not being used by the attending personnel. As also can be seen, hinges 24 are provided to pivotally affix the side doors 12 to the base of an incubator in conventional manner. The hinge for the end door 14 is a different hinge, not shown in FIG. 1, and will be later explained.

Upper end wall brackets 26 are affixed to the upper periphery of the rear end wall 16 and each has a opening 28 that receives a movable latch member 30 from the latches 32. Basically, the latches 32 will be explained in more detail, however, from FIG. 1 it can be seen the latches have a movable latch member 30 that is spring biased upwardly. Thus the user can release the latch 32 by pressing downwardly on the movable latch member 30 to withdraw the movable latch member 30 from the opening 28 to open the latch 32 and thus be able to open the side doors 12. Basically the same type of latch 32 is located at each upper corner of the side doors 12. A further hole 34 is formed in the upper end brackets 26 to provide an alignment with the hood 18 when the hood 18 is in its lowered position and such alignment will also be later explained.

In a similar manner, upper front door brackets 36 are affixed to the upper edge of the front end door 14 and also have the same openings 28 to receive the movable latch members 30 of the latches 32 and a hole 34 is also located in the upper front door brackets 36 for alignment with the hood 18. As can now be seen, however, by a simple manipulation of the latches 32, both of the side doors 12 can be pivoted about their hinges 24 to open and close those side doors 12. As can also be seen, there are pins 38 affixed to the hood 18 and depend downwardly therefrom and which enter the holes 34 in the upper end wall bracket 26 and the upper front door bracket 36 to align the hood 18 when moved to its lower position as explained.

In the preferred embodiment, the side doors 12 are double walled doors and each have an inner wall 42 and an outer wall 44 so that heated air can pass between the inner and outer walls 42, 44 to provide warmth to an infant located within the apparatus. Thus, there are tabs 46 that depend downwardly from the lower edge of the hood 18 and which enter into the passageway 48 formed between inner and outer walls 42, 44 to brace the side doors 12 when the hood 18 is in its lowered position. The tabs 46, in the preferred embodiment, enter the passageway 48 and thus brace the outer wall 44 so that such outer wall 44 can resist being pushed inwardly by persons or objects and therefore will maintain a good seal against the lower edge of the hood 18 and the upper edge of the side doors 12 even when inadvertently pushed inwardly. In the event the apparatus has only a single walled door, however, it is clear that the use of tabs 46 can still be used with a single walled door to brace the upper edge of the door when the hood is lowered.

Figure 2:
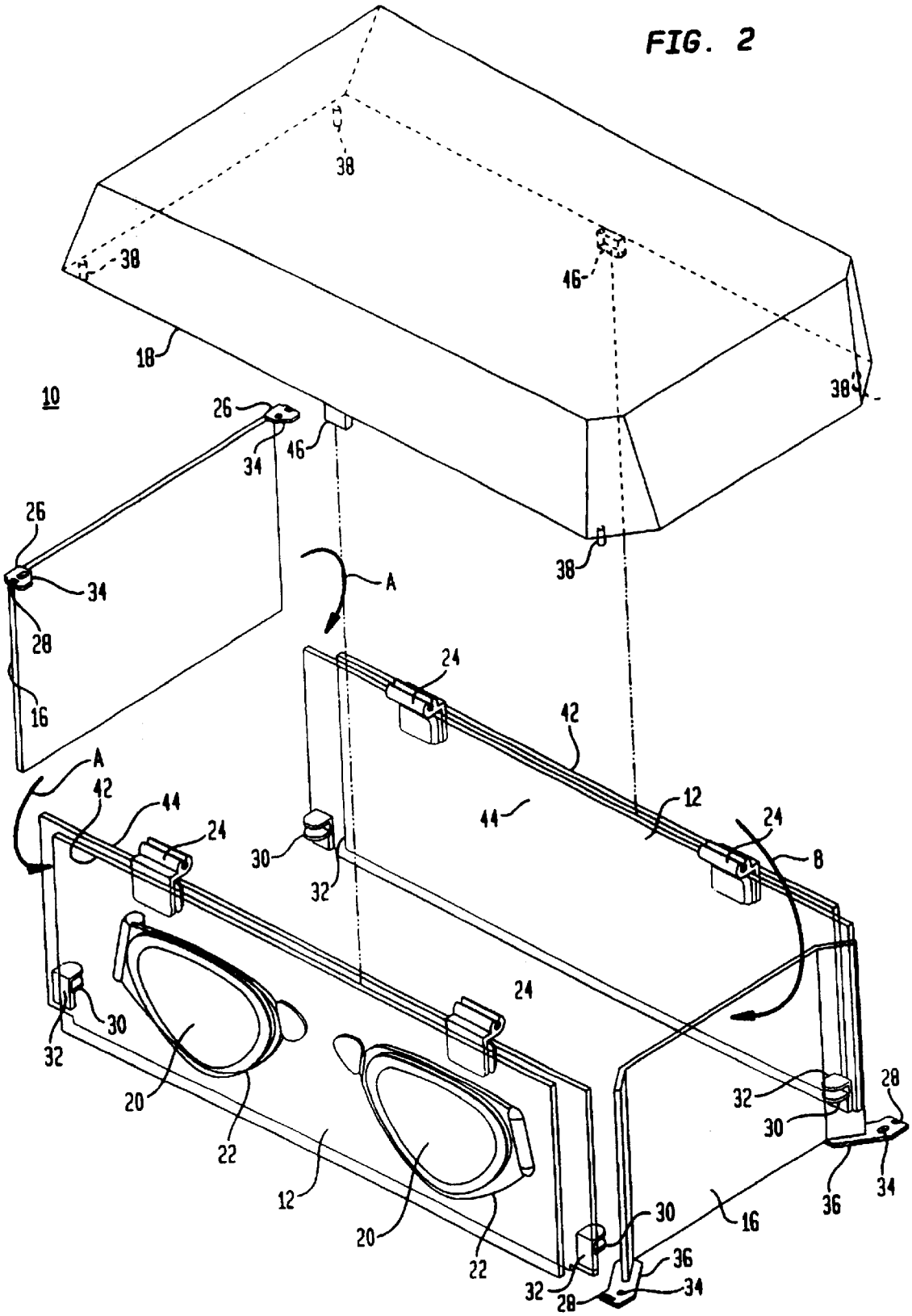
FIG. 2 is a perspective view of the incubator of FIG. 1 with three doors open.

Turning now to FIG. 2, there is shown the incubator 10 as described with respect to FIG. 1 with the side doors 12 and the front end door 14 in the open position. In the FIG., therefore, the side doors 12 have been pivoted in the direction of the arrows A so as to open outwardly and downwardly and the end door 14 also pivoted in the direction of the arrow B to the same open position. Thus, in FIG. 2, there is full access to an infant contained within the apparatus and the hood 18 is in its raised position. As such, therefore, the rear end wall 16 remains fixed in position, as shown, and all of the other walls of the generally rectangular configuration, comprise doors that can be opened for access to the infant positioned within the infant compartment. As also can be seen, that access is virtually unlimited with the hood 18 as show that has been vertically displaced upwardly for that access to the infant, however, all of the doors, that is, the side door 12 and the front end door 14 are all openable with the hood 18 also in its lower position.

Figure 3:
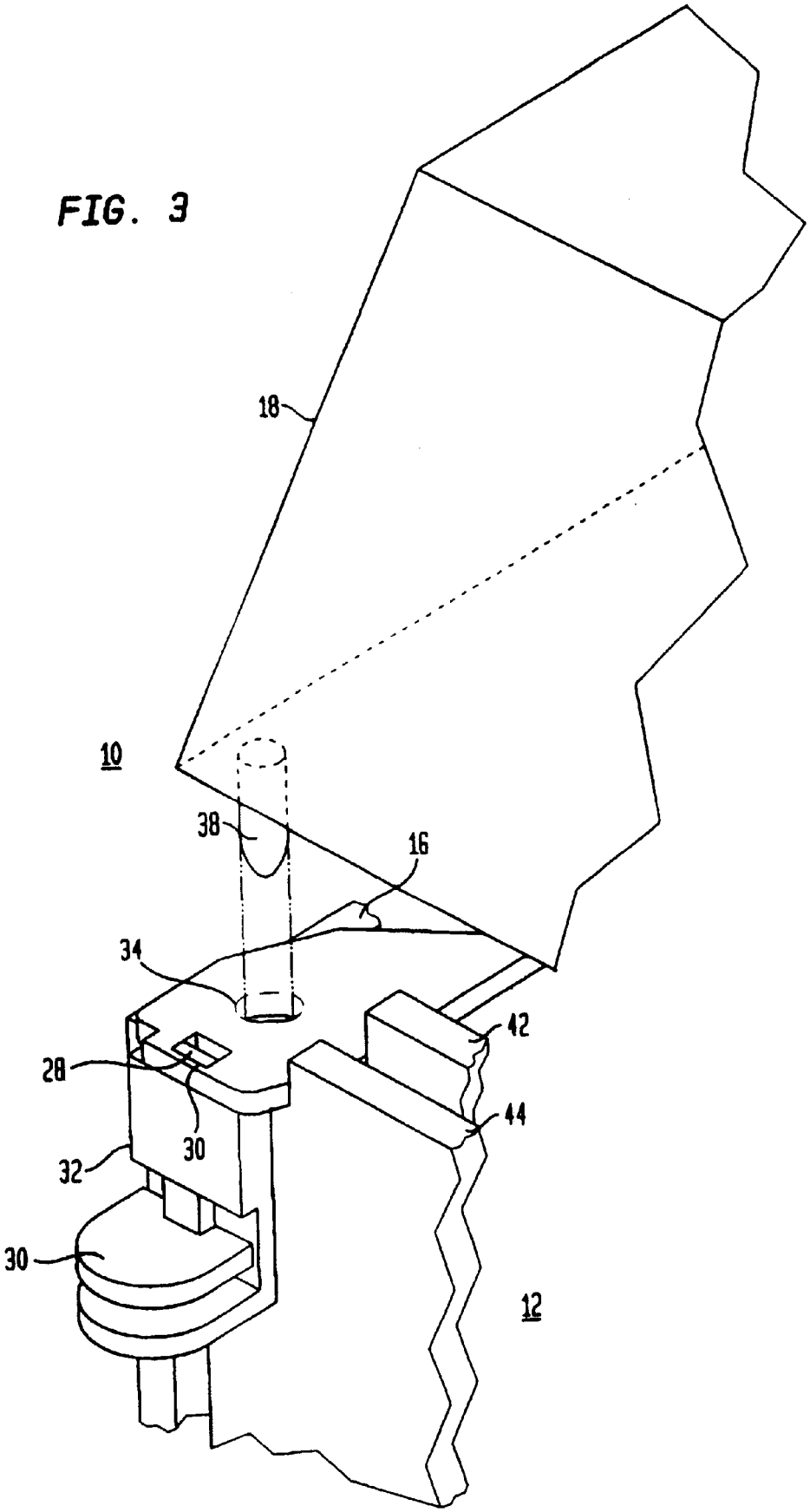
FIG. 3 is an enlarged view of one of the alignment features of the present invention.

Turning now to FIG. 3 there is shown an enlarged perspective view of one of the side doors 12 having a latch 32 in accordance with the present invention. As can be seen, the moveable latch member 30 can be depressed downwardly by the user against a spring bias to withdraw that movable latch member 30 from its position projecting into the opening 28 so that the side door 12 can be opened, it being obvious that the same maneuver must be carried out on latch on the other end of the side door so that both latches are opened at the same time. Accordingly, by a simple movement of the movable latch member 30, the side doors 12 can be opened and closed by the user. As also shown in FIG. 3, the pin 38 of hood 18 aligns with the hole 34 to align the hood 18 and the side doors 12 and end wall 16 of the apparatus as the hood 18 moves to its lower position and also to provide additional rigidity to the overall structure.

In the preferred embodiment, in view of the tolerances required in the construction of the overall incubator 10, two diagonally opposite holes 34 of the incubator 10 are elongated, as shown in FIG. 1, and the other two diagonally opposite holes may be circular. The use of the elongated holes allows the tolerances in the incubator to be reasonable for manufacture and still allow the use of the pins 38 to fit into the holes 34 for alignment and overall integrity of the incubator 10.

Figure 4:
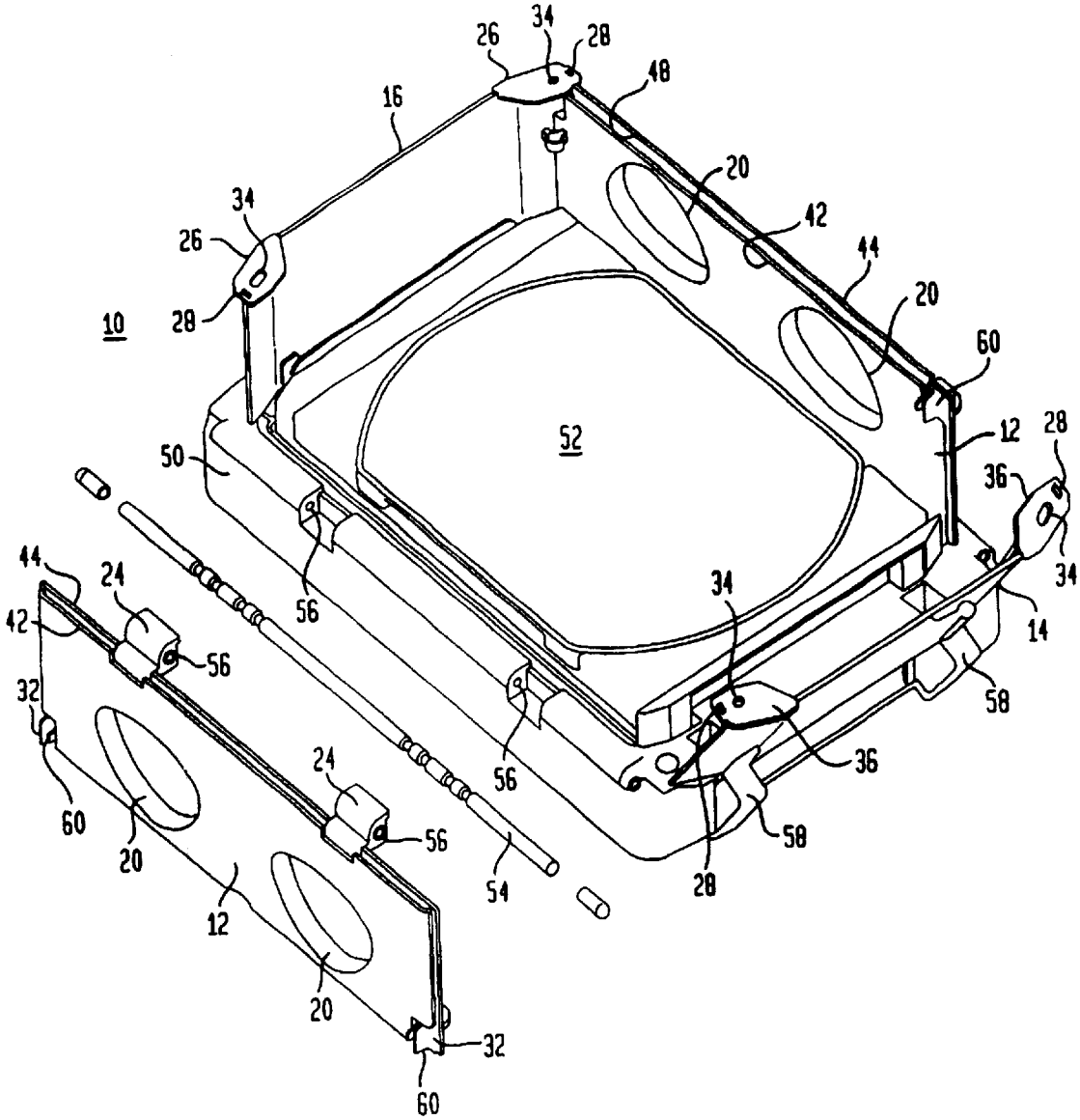
FIG. 4 is an exploded perspective view of the incubator of the present invention.

Turning next to FIG. 4, there is shown an exploded perspective view of the incubator 10 constructed in accordance with the present invention. In the FIG., there is shown the base 50 of the incubator and which generally contains the convective heating system to provide the heated air through the passageway 48 formed between the inner and outer walls 42, 44. An infant mattress 52 can be positioned atop of the base 50 for the comfort of the infant when contained within the incubator 10. In the FIG., the affixation of the side doors 12 to the base 50 is also seen and one means is by use of a rod 54 that passes through bores 56 formed in the base 50 as well as in the hinges 24 to pivotally affix the side door 12 to the base 50. Both side doors are similarly hinged to the base 50.

The front end door 14, however is hingedly affixed to the base 50 by a differing means and it is noted in FIG. 4 that there are front end door hinges 58 that join the front end door 14 to the base 50. The front end door hinges 58, as will become clear, provide a pivotal mounting of the front end door 14 to the base 50 but additionally allow the front end door 14 to be lifted vertically without becoming detached from the base 50. Thus, the front end door 14 can be both lifted vertically and still pivoted with respect to the base 50 to carry out the opening and closing of the front end door 14.

As a further feature seen in FIG. 4, to be later explained, there are vertically oriented flat projections 60 that extend outwardly from the latches 32 and act to align the movable latch members 30 to the openings 28 to make sure the alignment is correct to allow the latching and unlatching of the side doors 12 with respect to the upper front door brackets 36 and the upper end wall brackets 26.

Figure 5:
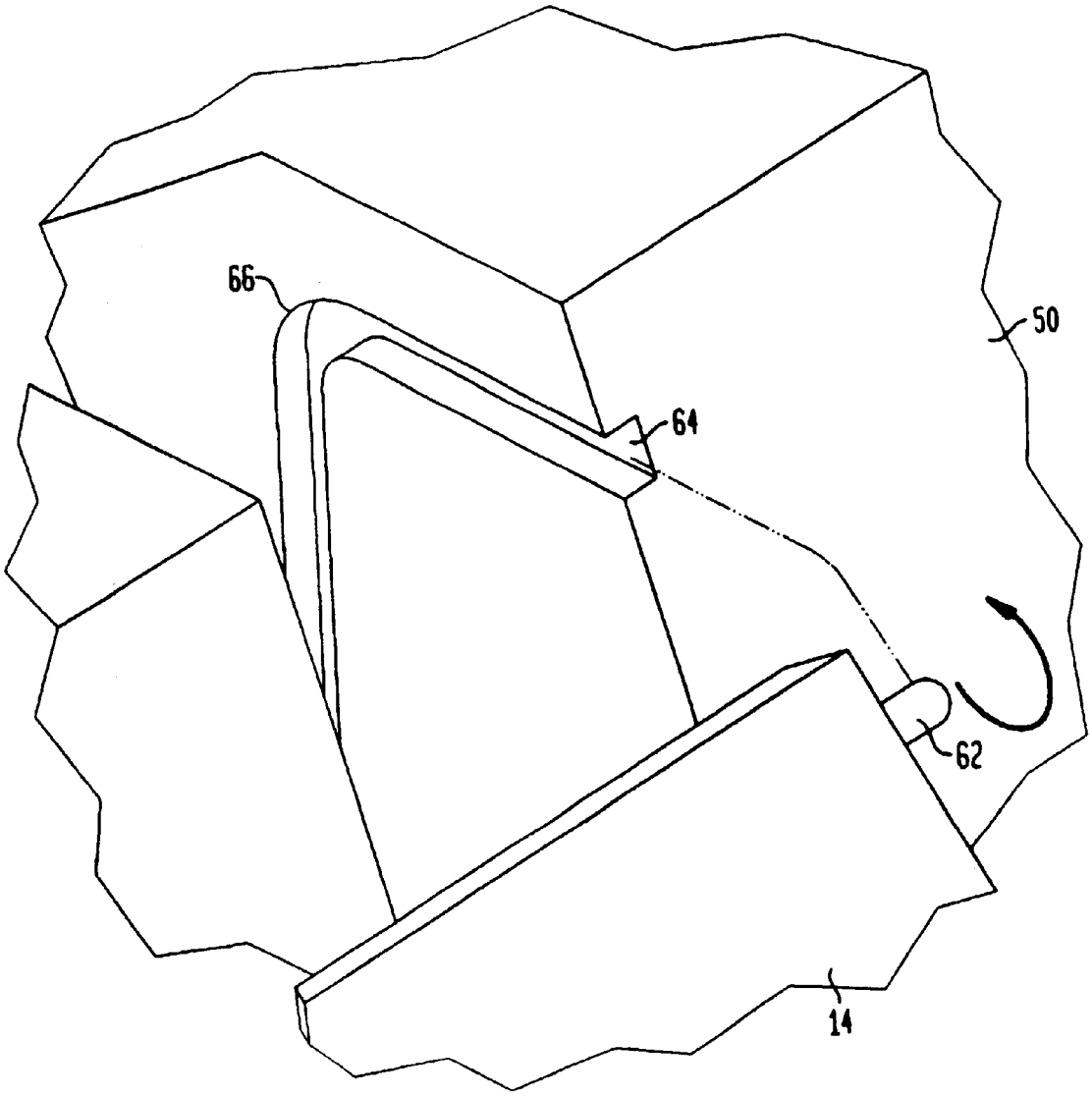
FIG. 5 is an enlarged perspective view of an end door opening feature.

In FIG. 5, there is shown the means of affixing the front end door 14 to the base 50 of the incubator 10. As described, the front end door hinges 58 (FIG. 4) allow the front end door 14 to move vertically as well as pivot. As part of that arrangement, the front end door 14 has outwardly extending guides 62 that extend from both sides of the front end door 14 and which are fitted into and ride within slots 64, only one of which is shown in FIG. 5. Thus, to open the front end door 14, the front end door 14 is lifted upwardly such that the outwardly extending guides 62 reach the curve 66 in the slots 64 and then the front end door 14 can be moved to the open position where it is pivoted outwardly and downwardly.

By the use of a vertical movement, the front end door 14 can be opened even when the side doors 12 are still closed since the vertical movement allows the openings 28 (FIG. 2) formed in the upper front door brackets 36 to be raised with respect to the movable latch members 30 of the latches 32. By moving the front end door 14 upwardly, therefore, the movable latch members 30 are withdrawn from the openings 28 to allow the end door 14 to swing free of the latches 32 to open. As can be conventional, there may be, of course, another set of lower outwardly extending guides that extend from the sides of the front end door 14 that ride with a vertical slot formed in the base 50, not shown, and which guides can be captured in that vertical slot so that the front end door 14 can be opened and still be firmly affixed to the base 50.

Accordingly the side doors 12 can be opened at will individually or both at the same time by using the latches 32 to move the movable latch members 30 downwardly to withdraw from the openings 28 and free the side doors 12. The same mechanism allows the front end door 14 to be raised vertically to create the same effect, that is, now the openings 28 move upwardly to cause the withdrawal of the movable latch members 30 from the openings 28.

Turning finally to FIGS. 6A, 6B, 6C and 6D, there is shown a cutaway enlarged perspective views of an alignment means for the corners of the side doors 12, an enlarged side view of the means and a cross sectional view of a component of the means taken along the line D—D of FIG. 6C. In FIGS. 6A–D, the projections 60 extend outwardly from the latches (FIG. 4) and those projections 60 are blade-like shaped with a vertically orientated flattened plane. As a part of the upper end brackets 26 and the upper door brackets 36 there is a housing 68 depending downwardly having a wedge shaped recesses 70 that receives the projections 60 and guides those projections into the wedge shaped recesses 70 to draw the end door 14 and the end wall 16 into the proper alignment with the latches 32 to insure that the movable latch members will line up with the openings 28.

Thus, as the side doors 12 are closed to be retrained by the latches 32, the alignment is assured between the movable latch members 30 to properly enter the openings 28 through the use of the projections 60 that enter the wedge shaped recesses 70 to bring about that alignment as the projections 60 move further into the wedge shaped recesses 70.

Those skilled in the art will readily recognize numerous adaptations and modifications which can be made to the infant care apparatus of the present invention which will result in improved features, yet all of which will fall within the scope and spirit of the present invention as defined in the following claims. Accordingly, the invention is to be limited only by the following claims and their equivalents.

We claim:

1. An infant care apparatus, said infant apparatus comprising a base, a pair of lateral side walls pivotally affixed to said base between an upward, closed position and a lowered, open position, a front end wall and a rear end wall affixed to said base and extending upwardly therefrom in an upward position, said lateral side walls and said front and rear end walls having upper surfaces forming, when in said upward positions, an upper peripheral edge, a vertically movable hood, said hood having an open position wherein said hood is displaced upwardly with respect to the upper peripheral edge and a closed position wherein said hood is seated against the upper peripheral edge to enclose therein an infant compartment, a bracket means affixed to the upper surfaces of said front end wall and said rear end wall, each of said bracket means having a hole therein, said vertically movable hood having a plurality of pins extending downwardly therefrom, said pins adapted to enter into said holes in each of said bracket means when said hood is lowered to said closed position.

2. An infant apparatus as defined in claim 1 where said bracket means comprises a pair of brackets located at opposite upper edges of said front and said rear end walls, and said hood has four pins, each of said pins adapted to enter one of said holes in said brackets.

3. An infant apparatus as defined in claim 2 wherein said holes in said brackets comprise four holes, one of said four holes being located at each of opposite upper surfaces of the front and rear end walls in a rectangular configuration and at least two diagonally oppositely located holes are elongated holes.

4. An infant apparatus, said infant apparatus comprising a base, a pair of lateral side walls pivotally affixed to said base between an upward, closed position and a lowered, open position, a front end wall and a rear end wall affixed to said base and extending upwardly therefrom in an upward position, said lateral side walls and said front and rear end walls having upper surfaces forming, when in said upward position, an upper peripheral edge, a vertically movable hood, said hood having an open position wherein said hood is displaced upwardly with respect to the upper peripheral edge and a closed position wherein said hood is seated against the upper peripheral edge to enclose therein an infant compartment, at least one bracket affixed to the upper surfaces of said front end wall and said rear end wall, each of said brackets having a opening therein, at least one movable latch member affixed to said lateral side walls, said at least one movable latch member adapted to align with an opening in one of said at least one bracket when said movable latch member enters said opening to affix said lateral side walls in said upward, closed position.

5. An infant care apparatus as defined in claim 4 wherein said hood includes pins depending downwardly therefrom that engage said at least one bracket in said front and rear end walls to stabilize said front and rear end walls.

6. An infant care apparatus as defined in claim 5 wherein said pins engage said front and rear end walls by passing through said holes formed in said brackets.

7. An infant apparatus as defined in claim 6 wherein said at least one bracket comprises a pair of brackets oppositely disposed at the upper surface of said front and said rear end walls.

8. An infant apparatus as defined in claim 7 wherein said at least one movable latch member comprises a pair of latches oppositely disposed at the upper surface of said lateral side walls.

9. An infant apparatus as defined in claim 8 wherein said movable latch members are biased upwardly when said lateral side walls are in said upward, closed positions.

10. An infant apparatus, said infant apparatus comprising a base, a pair of lateral side walls, a front end wall and a rear end wall affixed to said base, said rear end wall extending upwardly therefrom in an upward position, said lateral side walls and said front end wall being pivotally affixed to said base between an upward, closed position and a lowered, open position, said lateral side walls and said front and rear walls having upper surfaces forming, when in said upward position, an upper peripheral edge, a vertically movable hood, said hood having an open position wherein said hood is displaced upwardly with respect to the upper peripheral edge and a closed position wherein said hood is seated against the upper peripheral edge to enclose therein an infant compartment, at least one bracket affixed to the upper surfaces of said front end wall and said rear end wall, each of said at least one brackets having a opening therein, at least one movable latch member affixed to said side lateral walls, said at least one movable latch member adapted to align with an opening in each of said at least one brackets wherein said at least one movable latch member enters said opening to affix said lateral side walls in said upward, closed position.

11. An infant apparatus as defined in claim 10 wherein said at least one movable latch member comprises a pair of latch members located at opposite upper ends of said lateral side walls.

12. An infant apparatus as defined in claim 11 wherein said latch members are biased vertically upwardly when said lateral side walls are in said upward, closed position.

13. An infant apparatus as defined in claim 11 wherein said at least one bracket comprise a pair of brackets located at opposite upper ends of said front end and said rear end walls.

14. An infant apparatus as defined in claim 10 wherein said apparatus further including an alignment means to align said at least one movable latch member with said openings.

15. An infant apparatus as defined in claim 14 wherein said alignment means comprises an plurality of housings affixed to said front and rear end walls, said housings each having an elongated wedge shaped recess that tapers inwardly in depth and said lateral side walls have a plurality of projections that are adapted to enter said wedge shaped recesses to align said at least one movable latch member with each of said openings.

16. An infant apparatus as defined in claim 15 wherein said projections are vertically oriented flattened planes that enter said wedge shaped recesses to cause a horizontal alignment of said at least one movable latch with each of said openings in said brackets.

17. An infant apparatus as defined in claim 16 wherein said plurality of housings are integrally formed with said brackets.

18. An infant apparatus, said infant apparatus comprising a base, a pair of lateral side walls, a front end wall and a rear end wall affixed to said base, said rear end wall held in a fixed position with respect to said base and extending upwardly from said base, said lateral side walls and said front end wall being pivotally affixed to said base between an upward, closed position and a lowered, open position, said lateral side walls and said front and rear end walls having upper surfaces forming, when in said upward, closed position, an upper peripheral edge, said lateral side walls and said front end wall being openable by pivoting downwardly, at least one bracket affixed to the upper surface of said front end wall and said rear end wall, each of said at least one brackets having a opening therein, at least one movable latch member affixed to said side lateral walls, said at least one movable latch member adapted to align with the opening in each of said at least one brackets wherein said at least one movable latch member enters said opening to affix said lateral side walls in said upward, closed position.

19. An infant apparatus as defined in claim 18 wherein said apparatus further including an alignment means to align said at least one movable latch member with said openings.

20. An infant apparatus as defined in claim 19 wherein said alignment means comprises a plurality of housings affixed to said front and rear end walls, said housings each having an elongated wedge shaped recess that tapers inwardly in depth and said lateral side walls have a plurality of projections that are adapted to enter said wedge shaped recesses to align said at least one movable latch member with said openings.

21. An infant apparatus as defined in claim 20 wherein said projections are vertically oriented flattened planes that enter said wedge shaped recesses to cause a horizontal alignment of said at least one movable latch member with said openings in said brackets.

* * * * *